US008434629B2

(12) United States Patent
Fernandez

(10) Patent No.: US 8,434,629 B2
(45) Date of Patent: May 7, 2013

(54) ADJUSTABLE SHELVING SYSTEM WITH OVERLAPPING TRACKS

(75) Inventor: Julio A. Fernandez, Dunnellon, FL (US)

(73) Assignee: Clairson Inc., Newark, DE (US)

( * ) Notice: Subject to any disclaimer, the term of this patent is extended or adjusted under 35 U.S.C. 154(b) by 147 days.

(21) Appl. No.: 13/083,108

(22) Filed: Apr. 8, 2011

(65) Prior Publication Data

US 2012/0255925 A1 Oct. 11, 2012

(51) Int. Cl.

| | |
|---|---|
| ***A47F 5/0846*** | (2006.01) |
| ***A47F 5/08*** | (2006.01) |
| ***A47F 5/103*** | (2006.01) |
| ***A47F 5/101*** | (2006.01) |
| ***A47G 25/746*** | (2006.01) |

(52) U.S. Cl.
USPC ..... 211/94.01; 211/87.01; 211/103

(58) Field of Classification Search ..... 211/87.01, 211/103, 175, 94.01; 248/243–245, 354.6, 248/354.7, 354.1; 52/632, 655.1, 848, 845, 52/111; 403/263, 353
See application file for complete search history.

(56) References Cited

U.S. PATENT DOCUMENTS

| | | | | |
|---|---|---|---|---|
| D5,634 | S | 3/1872 | Wunder | |
| 948,349 | A * | 2/1910 | Settle | 280/298 |
| 1,006,328 | A | 10/1911 | Widenhofer | |
| 1,055,201 | A * | 3/1913 | Mason | 248/244 |
| D47,726 | S | 8/1915 | Heulings, Jr. | |
| D47,730 | S | 8/1915 | Heulings, Jr. | |
| D48,426 | S | 4/1929 | Whincap | |
| D78,426 | S | 4/1929 | Whincap | |
| 1,793,036 | A | 2/1931 | Whitney | |
| 1,997,432 | A | 4/1935 | Replogle | |
| 2,020,991 | A | 11/1935 | Brody | |
| 2,057,429 | A | 10/1936 | Heim | |
| D108,811 | S | 3/1938 | Snyder | |
| 2,266,274 | A | 12/1941 | Schroeder | |
| 2,299,885 | A | 10/1942 | Ellsworth et al. | |
| 2,345,650 | A | 4/1944 | Attwood | |
| 2,350,113 | A * | 5/1944 | Hurley | 248/354.6 |
| 2,441,721 | A | 5/1948 | Schroeder | |
| D165,937 | S | 2/1952 | Rosenbaum | |
| 2,651,489 | A | 9/1953 | Bell | |

(Continued)

FOREIGN PATENT DOCUMENTS

| | | |
|---|---|---|
| EP | 0338872 | 10/1989 |
| FR | 2717994 | 10/1995 |

(Continued)

*Primary Examiner* — Jennifer E Novosad
(74) *Attorney, Agent, or Firm* — Harness, Dickey & Pierce, P.L.C.

(57) ABSTRACT

A track assembly for a shelving system is disclosed that includes at least two tracks. The tracks are configured to slide relative to each other in an overlapping manner. Each track has one or more fastener holes along a longitudinal length of the track and one or more portions protruding outwardly from the track. The one or more protruding portions defining one or more recessed portions on an opposite side of the track, such that at least one protruding portion of one track is configured to be slidably engageable within at least one recessed portion of the other track when the corresponding overlapping fastener holes are aligned. The slidable engagement of the one or more protruding portions of one track within the one or more recessed portions of the other track may thus indicate that the tracks have been slidably positioned relative to each other with their overlapping fastener holes aligned.

20 Claims, 14 Drawing Sheets

U.S. PATENT DOCUMENTS

| | | | | | |
|---|---|---|---|---|---|
| 2,683,890 | A | | 7/1954 | Rosenbaum | |
| 2,683,891 | A | | 7/1954 | Rosenbaum | |
| 2,757,804 | A | * | 8/1956 | Sadwin | 211/94.01 |
| 2,767,951 | A | | 10/1956 | Cousino | |
| 2,809,002 | A | | 10/1957 | Rudolph | |
| D189,163 | S | | 11/1960 | Growe | |
| 2,963,127 | A | * | 12/1960 | Manville | 52/693 |
| D192,849 | S | | 5/1962 | McEvoy et al. | |
| 3,221,894 | A | | 12/1965 | Knuth | |
| 3,263,951 | A | | 8/1966 | Stokes | |
| 3,410,231 | A | | 11/1968 | Fletcher | |
| D215,697 | S | | 10/1969 | Toder | |
| 3,476,008 | A | | 11/1969 | Pearson et al. | |
| 3,499,541 | A | | 3/1970 | Mackie | |
| 3,563,182 | A | | 2/1971 | MacFarlane et al. | |
| 3,565,381 | A | | 2/1971 | Oliver | |
| D221,251 | S | | 7/1971 | Haskell et al. | |
| 3,621,751 | A | | 11/1971 | Fiorentino | |
| 3,640,389 | A | | 2/1972 | Snyder | |
| 3,645,486 | A | * | 2/1972 | Ferdinand et al. | 248/243 |
| D227,742 | S | | 7/1973 | Logdson | |
| 3,756,115 | A | | 9/1973 | Schuplin | |
| 3,760,744 | A | | 9/1973 | Cruckshank | |
| D228,852 | S | | 10/1973 | Vogelhuber et al. | |
| 3,784,023 | A | | 1/1974 | Varon et al. | |
| 3,978,799 | A | | 9/1976 | Escalette | |
| 3,993,002 | A | | 11/1976 | Stroh | |
| 3,998,170 | A | | 12/1976 | Gordon | |
| 4,021,012 | A | * | 5/1977 | Miller | 248/352 |
| D244,668 | S | | 6/1977 | Tegner | |
| 4,098,480 | A | | 7/1978 | Neumann | |
| 4,125,050 | A | | 11/1978 | Schwartzman et al. | |
| 4,155,312 | A | | 5/1979 | Thorkildson | |
| D252,668 | S | | 8/1979 | Rudinski | |
| 4,209,111 | A | | 6/1980 | Lotspeich et al. | |
| 4,218,058 | A | * | 8/1980 | Hilbert et al. | 473/488 |
| D256,843 | S | | 9/1980 | Madsen | |
| D258,489 | S | | 3/1981 | Gipson | |
| D259,080 | S | * | 5/1981 | Conti | D8/381 |
| D259,143 | S | | 5/1981 | Aktinson | |
| 4,444,323 | A | * | 4/1984 | Travis | 211/193 |
| 4,523,722 | A | | 6/1985 | Cohen et al. | |
| D279,959 | S | | 8/1985 | Nimmo et al. | |
| 4,533,056 | A | | 8/1985 | Krikorian | |
| 4,548,327 | A | | 10/1985 | Kilkelly | |
| 4,603,781 | A | | 8/1986 | Ryan, Jr. | |
| D286,495 | S | | 11/1986 | Blomdahl | |
| D288,528 | S | | 3/1987 | Parad | |
| 4,646,998 | A | | 3/1987 | Pate | |
| 4,671,419 | A | | 6/1987 | Beverly | |
| 4,688,750 | A | * | 8/1987 | Teague et al. | 248/243 |
| D291,646 | S | | 9/1987 | Koziol | |
| 4,693,380 | A | | 9/1987 | Muth | |
| 4,708,552 | A | | 11/1987 | Bustos et al. | |
| D293,416 | S | | 12/1987 | Krueger | |
| 4,720,016 | A | * | 1/1988 | Kay | 211/96 |
| 4,728,238 | A | | 3/1988 | Chisholm et al. | |
| 4,732,284 | A | | 3/1988 | Remmers | |
| D295,182 | S | | 4/1988 | Remmers | |
| 4,735,325 | A | | 4/1988 | Remmers | |
| D295,472 | S | | 5/1988 | Remmers | |
| 4,749,159 | A | | 6/1988 | Hoff | |
| 4,781,349 | A | | 11/1988 | Remmers | |
| 4,783,035 | A | | 11/1988 | Remmers | |
| D298,801 | S | | 12/1988 | Satoh | |
| D299,212 | S | | 1/1989 | Murphy | |
| D299,436 | S | | 1/1989 | Muth | |
| 4,795,041 | A | | 1/1989 | Remmers | |
| 4,804,159 | A | | 2/1989 | Martel | |
| 4,830,531 | A | | 5/1989 | Condit et al. | |
| 4,838,451 | A | | 6/1989 | Arkell et al. | |
| D305,272 | S | | 12/1989 | Remmers | |
| 4,890,839 | A | | 1/1990 | Ayotte | |
| D311,860 | S | | 11/1990 | Remmers | |
| D312,389 | S | | 11/1990 | Remmers | |
| 4,984,694 | A | | 1/1991 | Magnusson | |
| 5,029,794 | A | * | 7/1991 | Wolfe | 248/343 |
| 5,074,223 | A | | 12/1991 | Remmers | |
| D323,452 | S | | 1/1992 | Stumpf et al. | |
| D323,715 | S | | 2/1992 | Bodurow et al. | |
| 5,086,936 | A | | 2/1992 | Remmers | |
| 5,110,080 | A | * | 5/1992 | Rieman | 248/225.11 |
| D326,605 | S | | 6/1992 | Nakanura | |
| 5,119,945 | A | | 6/1992 | Wiggins | |
| 5,133,463 | A | | 7/1992 | Merl | |
| 5,135,194 | A | | 8/1992 | Laughon et al. | |
| D334,497 | S | | 4/1993 | Putty | |
| D336,605 | S | | 6/1993 | Lemmerman et al. | |
| D340,639 | S | | 10/1993 | Remmers | |
| D342,015 | S | | 12/1993 | Andrejew | |
| D345,428 | S | | 3/1994 | Bancroft | |
| 5,305,898 | A | | 4/1994 | Merl | |
| D348,826 | S | | 7/1994 | McCaffrey | |
| 5,326,062 | A | | 7/1994 | Remmers | |
| 5,330,063 | A | | 7/1994 | Remmers | |
| 5,351,842 | A | | 10/1994 | Remmers | |
| D353,500 | S | | 12/1994 | Remmers | |
| 5,386,959 | A | | 2/1995 | Laughlin et al. | |
| 5,407,084 | A | | 4/1995 | Remmers | |
| 5,458,248 | A | * | 10/1995 | Alain | 211/175 |
| 5,472,103 | A | | 12/1995 | Merl | |
| 5,485,932 | A | | 1/1996 | Romm et al. | |
| 5,492,295 | A | | 2/1996 | Remmers | |
| D369,293 | S | | 4/1996 | Gusdorf et al. | |
| 5,509,541 | A | * | 4/1996 | Merl | 211/103 |
| 5,531,416 | A | | 7/1996 | Remmers | |
| 5,533,851 | A | | 7/1996 | Remmers | |
| D373,719 | S | | 9/1996 | Lin | |
| 5,580,018 | A | | 12/1996 | Remmers | |
| 5,584,405 | A | | 12/1996 | Tunzi | |
| 5,607,141 | A | * | 3/1997 | Clark | 254/200 |
| 5,638,644 | A | | 6/1997 | Bastian | |
| 5,645,182 | A | | 7/1997 | Miller, Jr. et al. | |
| 5,657,878 | A | * | 8/1997 | Austin | 211/41.8 |
| D392,553 | S | | 3/1998 | Dill | |
| 5,738,477 | A | | 4/1998 | McCorkle et al. | |
| D394,203 | S | | 5/1998 | Nadar | |
| 5,746,035 | A | * | 5/1998 | Seiber et al. | 52/238.1 |
| 5,752,610 | A | | 5/1998 | Remmers | |
| 5,755,414 | A | | 5/1998 | Remmers | |
| D394,999 | S | | 6/1998 | Phillip | |
| 5,758,851 | A | | 6/1998 | Remmers | |
| 5,769,247 | A | | 6/1998 | Merl | |
| 5,788,093 | A | | 8/1998 | Krut | |
| 5,833,193 | A | | 11/1998 | Derda et al. | |
| D402,536 | S | | 12/1998 | Cousins | |
| D403,234 | S | | 12/1998 | Nagato | |
| 5,860,716 | A | * | 1/1999 | Good et al. | 312/311 |
| D406,476 | S | | 3/1999 | Boije | |
| D408,175 | S | | 4/1999 | Daniels et al. | |
| D409,866 | S | | 5/1999 | West | |
| D411,738 | S | | 6/1999 | Raasch et al. | |
| 5,909,936 | A | | 6/1999 | Daniels et al. | |
| 5,921,411 | A | | 7/1999 | Merl | |
| 5,921,412 | A | | 7/1999 | Merl | |
| 5,934,631 | A | | 8/1999 | Becker et al. | |
| 5,950,974 | A | | 9/1999 | Hoffmann | |
| 6,053,465 | A | | 4/2000 | Kluge | |
| D423,917 | S | | 5/2000 | Remmers et al. | |
| D427,466 | S | | 7/2000 | Remmers | |
| 6,152,312 | A | * | 11/2000 | Nava et al. | 211/94.01 |
| 6,168,125 | B1 | * | 1/2001 | Winger et al. | 248/228.3 |
| D437,515 | S | | 2/2001 | Remmers et al. | |
| 6,189,527 | B1 | | 2/2001 | Walsh et al. | |
| D443,456 | S | | 6/2001 | Horsten | |
| 6,279,467 | B1 | | 8/2001 | Tiemann | |
| 6,349,911 | B1 | * | 2/2002 | Feldpausch et al. | 248/243 |
| 6,402,108 | B1 | | 6/2002 | Remmers | |
| 6,443,318 | B1 | | 9/2002 | Welsch | |
| 6,457,594 | B1 | | 10/2002 | Tiemann | |
| 6,467,860 | B2 | | 10/2002 | Remmers | |
| 6,494,653 | B2 | | 12/2002 | Remmers | |
| D470,398 | S | | 2/2003 | Remmers | |
| D477,144 | S | | 7/2003 | Remmers | |
| 6,626,509 | B2 | | 9/2003 | Remmers | |
| D482,601 | S | | 11/2003 | Chen | |
| 6,659,295 | B1 | | 12/2003 | De Land et al. | |

| | | | | |
|---|---|---|---|---|
| 6,669,154 | B1 | 12/2003 | Remmers | |
| D484,779 | S | 1/2004 | Shibuya | |
| D485,109 | S | 1/2004 | Oberhaus | |
| 6,688,568 | B1 | 2/2004 | Moufflet | |
| D490,690 | S | 6/2004 | Brass et al. | |
| D497,738 | S | 11/2004 | Sparkowski | |
| 6,823,997 | B2 * | 11/2004 | Linden et al. | 211/59.3 |
| 6,840,593 | B2 | 1/2005 | Remmers | |
| D506,385 | S | 6/2005 | Brown | |
| 6,915,913 | B2 | 7/2005 | Cardinell | |
| 6,918,499 | B2 | 7/2005 | De Land et al. | |
| 6,932,225 | B2 | 8/2005 | Rowe | |
| 6,953,176 | B2 | 10/2005 | Remmers | |
| 6,969,036 | B2 | 11/2005 | Magnusson | |
| D513,970 | S | 1/2006 | Sterling et al. | |
| 7,004,335 | B2 | 2/2006 | Remmers | |
| 7,021,730 | B2 | 4/2006 | Remmers | |
| D522,848 | S | 6/2006 | Nawrocki | |
| D522,852 | S | 6/2006 | Nawrocki | |
| D523,327 | S | 6/2006 | Clarke | |
| 7,063,491 | B2 | 6/2006 | French | |
| D525,115 | S | 7/2006 | Harwanko | |
| D525,811 | S | 8/2006 | Nawrocki | |
| D526,519 | S | 8/2006 | Nawrocki | |
| D526,887 | S | 8/2006 | Remmers et al. | |
| 7,086,543 | B2 | 8/2006 | Remmers | |
| 7,086,544 | B1 | 8/2006 | Doench | |
| 7,090,317 | B2 | 8/2006 | Remmers | |
| D527,559 | S | 9/2006 | Remmers | |
| D527,935 | S | 9/2006 | Remmers | |
| 7,100,795 | B2 * | 9/2006 | Kelly et al. | 221/131 |
| 7,104,411 | B2 | 9/2006 | Magnusson et al. | |
| D531,019 | S | 10/2006 | Plumer | |
| 7,121,417 | B2 | 10/2006 | Magnusson et al. | |
| D531,891 | S | 11/2006 | Nawrocki | |
| 7,174,605 | B1 | 2/2007 | Nawrocki | |
| 7,178,769 | B2 | 2/2007 | Magnusson et al. | |
| 7,185,772 | B2 | 3/2007 | Remmers | |
| 7,188,740 | B2 | 3/2007 | Marchetta et al. | |
| D543,094 | S | 5/2007 | Remmers | |
| D544,260 | S | 6/2007 | Nawrocki | |
| D544,261 | S | 6/2007 | Nawrocki | |
| 7,225,935 | B2 | 6/2007 | Breymaier et al. | |
| D547,163 | S | 7/2007 | Xayoiphonh | |
| D547,164 | S | 7/2007 | Xayoiphonh | |
| D547,640 | S | 7/2007 | Remmers | |
| 7,240,803 | B2 | 7/2007 | Stitchick et al. | |
| 7,255,237 | B2 | 8/2007 | Stitchick et al. | |
| D550,072 | S | 9/2007 | Ardern | |
| D550,540 | S | 9/2007 | Nawrocki | |
| D551,062 | S | 9/2007 | Nawrocki | |
| D551,884 | S | 10/2007 | Remmers | |
| D553,485 | S | 10/2007 | Hall | |
| 7,296,697 | B2 | 11/2007 | Costa et al. | |
| D559,090 | S | 1/2008 | Nawrocki | |
| 7,314,144 | B2 | 1/2008 | Stitchick et al. | |
| D562,670 | S | 2/2008 | Rogers et al. | |
| D567,074 | S | 4/2008 | Gallien | |
| D569,715 | S | 5/2008 | Fernandez | |
| 7,387,212 | B2 | 6/2008 | Costa et al. | |
| 7,392,911 | B2 | 7/2008 | Stitchick et al. | |
| 7,401,705 | B2 | 7/2008 | Craft | |
| 7,407,060 | B2 | 8/2008 | Swartz et al. | |
| D578,869 | S | 10/2008 | Fernandez | |
| D580,258 | S | 11/2008 | Fernandez | |
| D581,260 | S | 11/2008 | Fernandez | |
| D581,776 | S | 12/2008 | Yin-Feng | |
| 7,458,548 | B2 | 12/2008 | Franzone et al. | |
| D585,267 | S | 1/2009 | Di Vinadio | |
| D585,730 | S | 2/2009 | Fernandez | |
| D587,562 | S | 3/2009 | Fernandez | |
| 7,506,772 | B2 | 3/2009 | Chen | |
| D589,780 | S | 4/2009 | Fernandez | |
| 7,516,930 | B2 | 4/2009 | Chen | |
| D596,931 | S | 7/2009 | Fernandez | |
| D602,770 | S | 10/2009 | Fernandez | |
| 7,604,131 | B1 * | 10/2009 | Clark et al. | 211/17 |
| D621,244 | S | 8/2010 | Kundinger et al. | |
| 7,798,339 | B2 * | 9/2010 | Brooks et al. | 211/103 |
| 7,832,573 | B2 | 11/2010 | Magnusson et al. | |
| 7,900,783 | B2 | 3/2011 | Fernandez et al. | |
| D640,122 | S * | 6/2011 | Stearns et al. | D8/355 |
| D640,123 | S * | 6/2011 | Stearns et al. | D8/355 |
| 8,146,295 | B2 * | 4/2012 | Kibbel et al. | 49/504 |
| 8,210,368 | B2 * | 7/2012 | Schwartzkopf et al. | 211/103 |
| D668,945 | S * | 10/2012 | Fernandez | D8/377 |
| 2002/0090278 | A1 | 7/2002 | Lai | |
| 2002/0153335 | A1 | 10/2002 | Robideau | |
| 2002/0166934 | A1 | 11/2002 | Marsh | |
| 2003/0231941 | A1 | 12/2003 | Kenny | |
| 2003/0233965 | A1 | 12/2003 | Brazier | |
| 2003/0234231 | A1 | 12/2003 | Rowe | |
| 2004/0004049 | A1 * | 1/2004 | Geiger | 211/86.01 |
| 2004/0007550 | A1 | 1/2004 | Leeman et al. | |
| 2004/0045919 | A1 | 3/2004 | Remmers | |
| 2004/0108288 | A1 | 6/2004 | Breymaier et al. | |
| 2004/0200791 | A1 * | 10/2004 | Bostick et al. | 211/94.01 |
| 2004/0245197 | A1 * | 12/2004 | McElvaney | 211/184 |
| 2005/0011420 | A1 | 1/2005 | Costa et al. | |
| 2005/0109720 | A1 | 5/2005 | Marchetta | |
| 2005/0109901 | A1 | 5/2005 | Stitchick et al. | |
| 2005/0145147 | A1 | 7/2005 | Costa et al. | |
| 2005/0145588 | A1 | 7/2005 | Stitchick et al. | |
| 2005/0148942 | A1 | 7/2005 | Newby et al. | |
| 2005/0150436 | A1 | 7/2005 | Marchetta et al. | |
| 2005/0150850 | A1 | 7/2005 | Stitchick et al. | |
| 2005/0247651 | A1 | 11/2005 | Craft | |
| 2005/0247653 | A1 * | 11/2005 | Brooks | 211/94.01 |
| 2005/0284828 | A1 | 12/2005 | Remmers | |
| 2006/0011568 | A1 | 1/2006 | Remmers et al. | |
| 2006/0011570 | A1 | 1/2006 | Chen | |
| 2006/0102817 | A1 | 5/2006 | Swartz et al. | |
| 2006/0113443 | A1 | 6/2006 | Remmers | |
| 2006/0130983 | A1 | 6/2006 | Nien | |
| 2006/0175495 | A1 | 8/2006 | Gregory | |
| 2007/0023374 | A1 | 2/2007 | Nawrocki | |
| 2007/0068887 | A1 | 3/2007 | Nawrocki | |
| 2007/0101545 | A1 | 5/2007 | Nawrocki | |
| 2007/0102604 | A1 | 5/2007 | Nawrocki | |
| 2007/0108146 | A1 | 5/2007 | Nawrocki | |
| 2007/0108148 | A1 | 5/2007 | Stitchick et al. | |
| 2007/0114197 | A1 | 5/2007 | Remmers | |
| 2007/0114348 | A1 | 5/2007 | Nawrocki | |
| 2007/0119805 | A1 | 5/2007 | Nawrocki | |
| 2007/0134072 | A1 | 6/2007 | Su | |
| 2007/0137417 | A1 | 6/2007 | Nawrocki et al. | |
| 2007/0159040 | A1 | 7/2007 | Fernandez et al. | |
| 2007/0187561 | A1 | 8/2007 | Xayoiphonh | |
| 2007/0205172 | A1 | 9/2007 | Stitchick et al. | |
| 2007/0241072 | A1 | 10/2007 | Bryant et al. | |
| 2007/0257169 | A1 | 11/2007 | Taggett | |
| 2008/0047098 | A1 | 2/2008 | Nawrocki | |
| 2008/0237426 | A1 * | 10/2008 | Walters | 248/316.8 |
| 2009/0139943 | A1 | 6/2009 | Fernandez | |
| 2011/0210087 | A1 * | 9/2011 | berg | 211/94.01 |
| 2012/0255925 | A1 * | 10/2012 | Fernandez | 211/134 |

FOREIGN PATENT DOCUMENTS

| | | |
|---|---|---|
| GB | 2153205 | 8/1985 |
| GB | 2180141 | 3/1987 |
| GB | 2229625 | 10/1990 |
| JP | 10002663 | 1/1998 |
| WO | WO 02/26082 | 4/2002 |
| WO | WO 2004/056236 | 7/2004 |

* cited by examiner

ADJUSTABLE SHELVING SYSTEM WITH OVERLAPPING TRACKS

FIELD

The present disclosure relates generally to the use of tracks and standards for supporting shelving/shelf brackets and other components.

BACKGROUND

This section provides background information related to the present disclosure which is not necessarily prior art.

Standards may be used for supporting shelving or shelf brackets. A typical standard may include a relatively narrow strip of material with two columns of slots on the front surface thereof. The standard may be mounted vertically against a wall. Shelving brackets may be supported from the standard by inserting tabs of the shelving brackets into corresponding slots of the standard. The standard may be fixedly mounted to a wall using screws such that the standard is not generally adjustable, movable, or removable from its installed position.

SUMMARY

This section provides a general summary of the disclosure, and is not a comprehensive disclosure of its full scope or all of its features.

According to one aspect of the present disclosure, various embodiments of shelving systems are provided. In an exemplary embodiment, a shelving system generally includes at least two tracks that are configured to slide relative to each other in an overlapping manner. Each track has an upper flange portion that adjoins a lower flange portion. Each track further includes one or more ribs at a juncture of the adjoining upper and lower flange portions. Each track also includes one or more notches on a side of the track opposite the one or more ribs. At least one rib of one track is configured to be slidably engageable within at least one notch of the other track when the tracks are overlapped and aligned.

Another exemplary embodiment of a shelving system includes at least two tracks and at least one standard. The tracks are configured to slide relative to each other in an overlapping manner. Each track has one or more mounting apertures along a longitudinal length of the track and an upper flange portion that adjoins a lower flange portion. Each track also includes one or more portions protruding outwardly from the track. The one or more protruding portions define one or more recessed portions, such that at least one protruding portion of one track is configured to be slidably engageable within at least one recessed portion of the other track when the corresponding overlapping mounting apertures of the tracks are aligned. The standard includes an end portion configured to be slidable along and supportable by the tracks, thereby allowing the position of the standard to be slidably adjustable along the tracks.

In another exemplary embodiment, a track assembly for a shelving system includes at least two tracks. The tracks are configured to slide relative to each other in an overlapping manner. Each track has one or more fastener holes along a longitudinal length of the track and one or more portions protruding outwardly from the track. The one or more protruding portions defining one or more recessed portions on an opposite side of the track, such that at least one protruding portion of one track is configured to be slidably engageable within at least one recessed portion of the other track when the corresponding overlapping fastener holes are aligned. The slidable engagement of the one or more protruding portions of one track within the one or more recessed portions of the other track may thus indicate that the tracks have been slidably positioned relative to each other with their overlapping fastener holes aligned.

Further features, advantages, and areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

DETAILED DESCRIPTION

Figure 1:
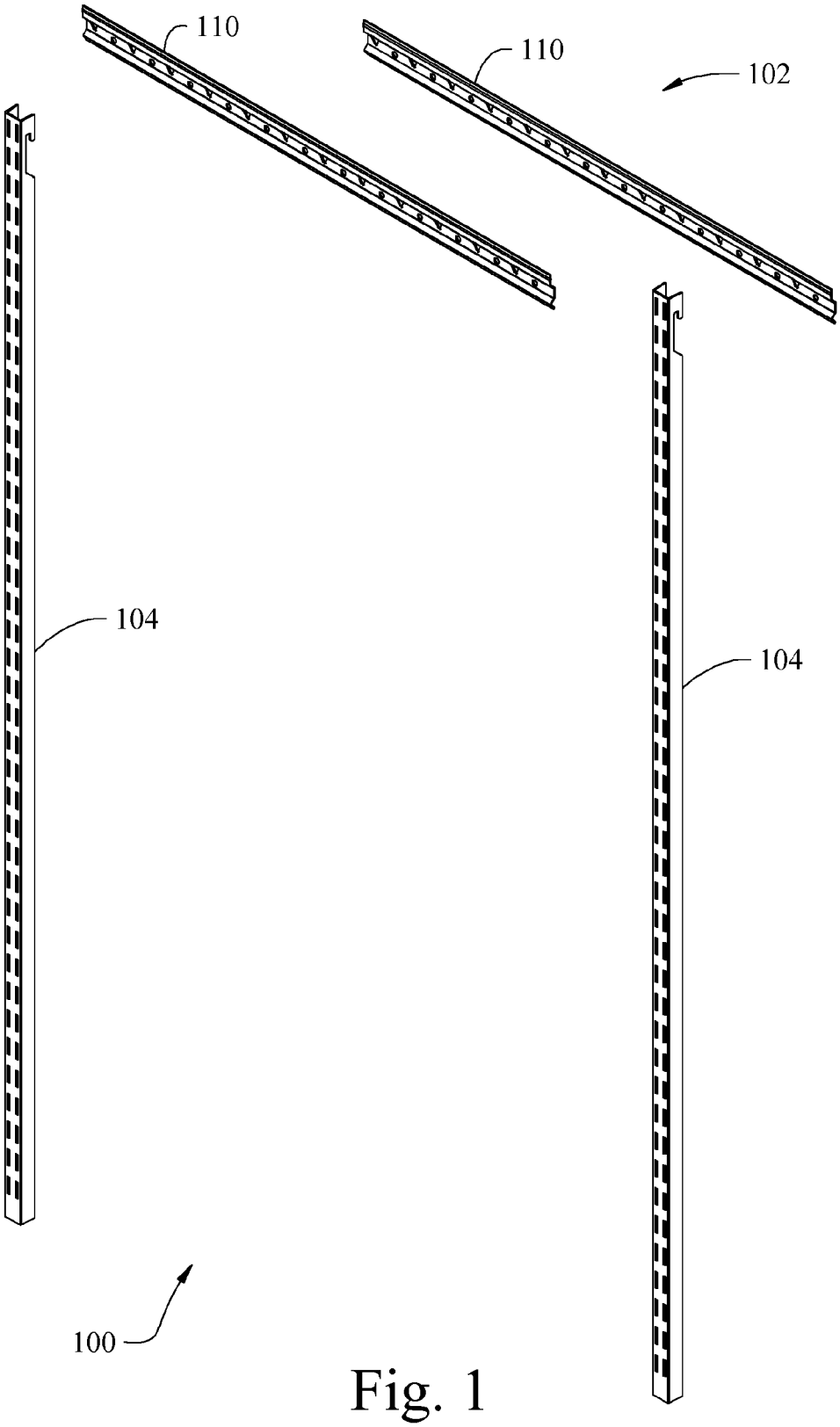
FIG. 1 is a perspective view of an exemplary embodiment of an adjustable shelving system having two tracks and two standards.

Example embodiments will now be described more fully with reference to the accompanying drawings.

According to aspects of the present disclosure, the inventor hereof discloses various exemplary embodiments of adjustable shelving systems having an overlapping adjustable track or top rail assembly for mounting, suspending, or hanging therefrom one or more vertical uprights or standards, which, in turn, may be used for supporting one or more shelves, shelving, etc. Disclosed herein are exemplary embodiments of tracks that are configured (e.g., shaped, sized, etc.) to be slidably overlapped. This slidably overlapping of the tracks allows for adjustment, e.g., shortening, of the overall track length without having to cut the either track.

One or both tracks may include outwardly extending gussets, ribs, protruberances, or protrusions that may be configured to be slidably engaged within corresponding notches, recesses, openings, or recessed portions defined by the other track. For example, one or more gussets outwardly extending from a front of the bottom or overlapped track may be slidable engaged within the corresponding one or more recessed portions or notches along the back of the top track. This slidable engagement may allow the tracks to index which may, for example, help an installer more easily align mounting apertures or fastener holes of one track with the corresponding mounting apertures or fastener holes of the other track. In exemplary embodiments, the gussets, notches, and fastener holes of the tracks may be positioned relative to each other such that when the gussets of one track are engaged within the notches of the other track, one or more fastener holes of the overlapped or bottom track are aligned with one or more corresponding fastener holes of the top track.

In addition, the slidable engagement of the gussets of one track within the corresponding notches of the other track may also be configured so such that a tactile indication and/or audible indication is provided to the installer when the tracks are indexed. For example, the engagement of the gussets of the bottom track into the notches of the top track may operate as a stop that inhibits the continued sliding movement of the tracks relative to each other, which may be felt by the installer. The tracks may also be configured (e.g., profile shapes, gussets, notches, etc.) such that they are retained or held together when overlapped. These features of the tracks may thus allow a single installer to more easily mount the tracks to a wall, etc.

In exemplary shelving systems, at least two tracks are configured to slide relative to each other in an overlapping manner. Each track has an upper flange portion that adjoins a lower flange portion. Each track further includes spaced-apart ribs, gussets, protrusions, protuberances, etc. formed at the juncture of the adjoining upper and lower flange portions. Each track also includes notches, recesses, or openings on the back of the track opposite the ribs. At least one rib of one track is configured to slidably engage at least one notch of the at least one other track, to provide for relative positioning of one track relative to the other in slidably adjusting the overall length of the overlapped tracks. The tracks may further comprise a plurality of spaced apart apertures or holes disposed along the longitudinal length of the track. The slidable engagement of the ribs of one track within the notches of the at least one other track aligns one or more apertures or holes of one track with one or more corresponding apertures or holes in the other track. The engagement of the ribs of one track within the notches of the at least one other track also enables indexed adjustment of the relative positioning of the at least two tracks. Exemplary shelving systems disclosed herein may further include one or more standards or vertical uprights. For example, a standard may include a recessed portion configured to receive the upper flange portion of either or both tracks, whereby the standard is supported by or suspended from the upper flange portion. In addition, the standard may also be slidable along the tracks, which thereby allows the standard's position to be slidably adjustable relative to the tracks.

With reference now to the figures, FIG. 1 illustrates an exemplary embodiment of an adjustable shelving system 100. As shown in FIG. 1, the adjustable shelving system 100 includes an adjustable track assembly having two tracks 110. Each track 110 may be identical to the other track 110, or they may be different (e.g., different lengths, different numbers of gussets 120 or fastener holes 124, etc.).

By way of example only, FIGS. 2 through 17 illustrate an exemplary embodiment of a track 110 that may be used in the adjustable shelving system 100 shown in FIG. 1. Other embodiments, however, may include differently configured tracks and/or more or less than two tracks 110. Additional embodiments may include two or more tracks that are longer or shorter relative to the other components than what is shown in FIGS. 1, 18, 33, and 34.

Figure 2:
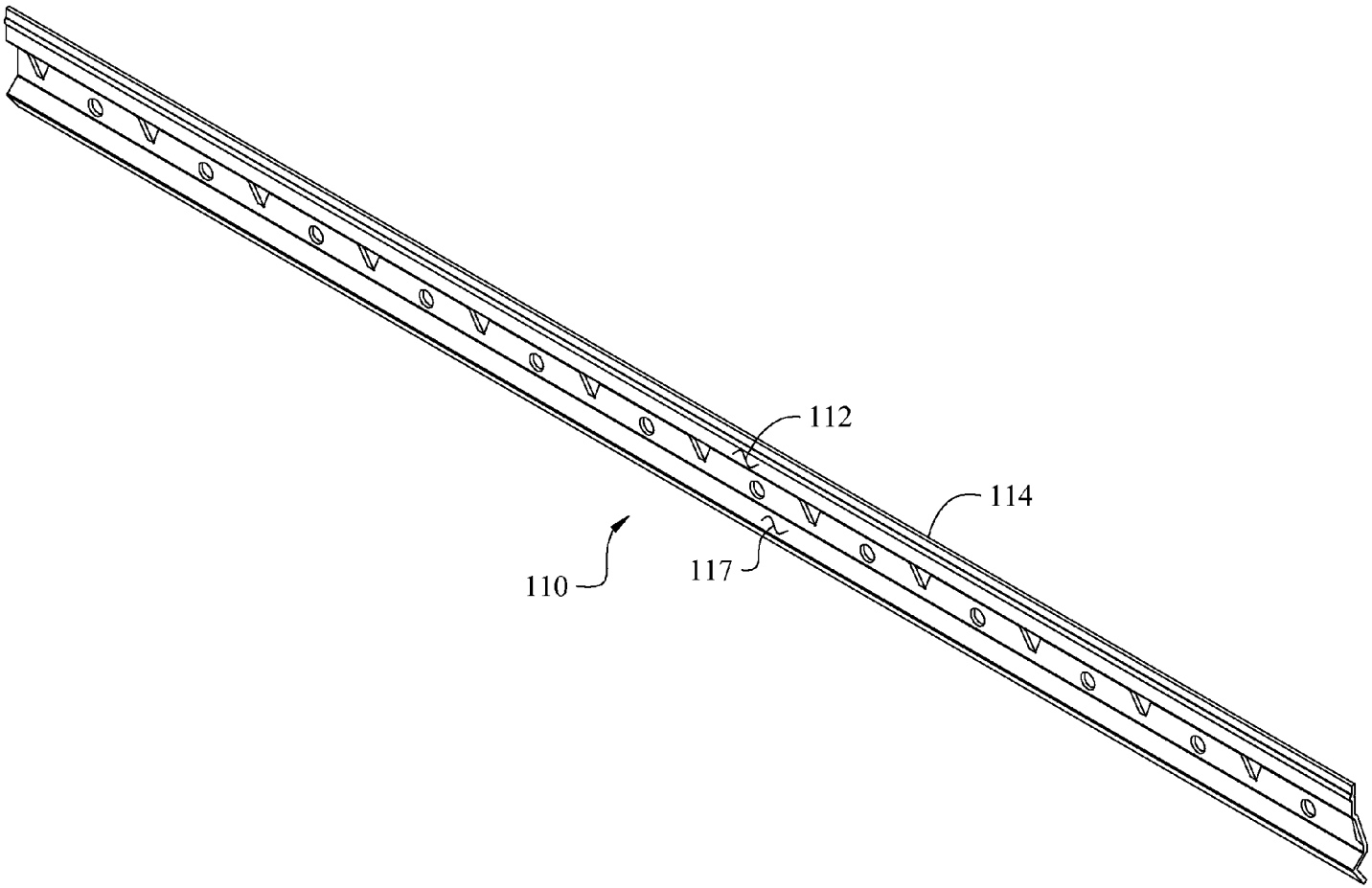
FIG. 2 is a perspective view of one of the two tracks shown in FIG. 1.

With continued reference to FIG. 2, the track 110 includes an upper flange portion 112 having an upper support surface 114. The track 110 also includes a lower flange portion 117 that adjoins the upper flange portion 112.

Figure 3:
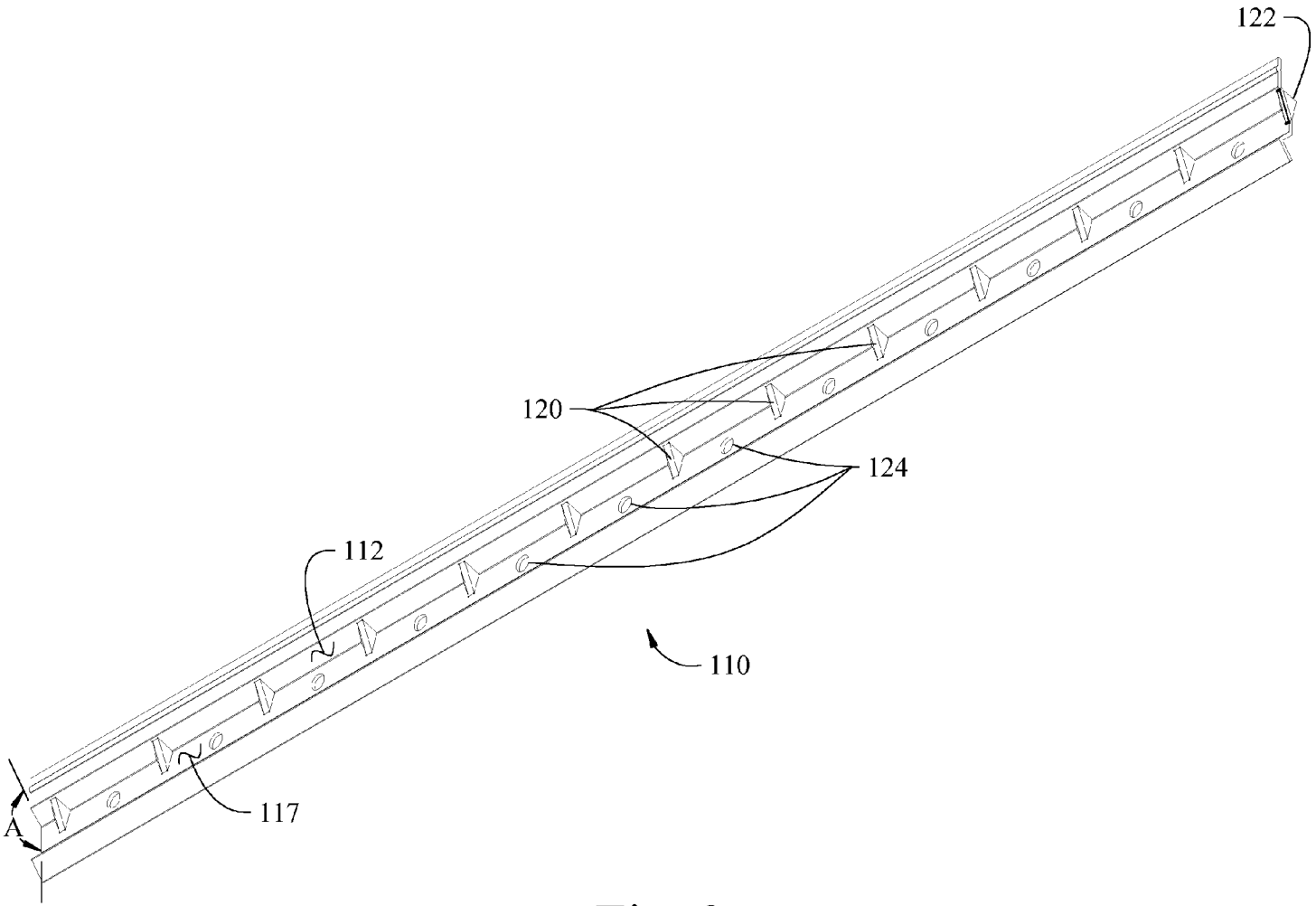
FIG. 3 is another perspective view of the track shown in FIG. 2.
Figure 5:
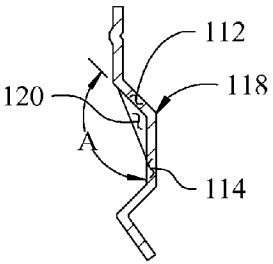
FIG. 5 is a side cross-sectional view showing the side profile of the track shown in FIG. 2.
Figure 8:
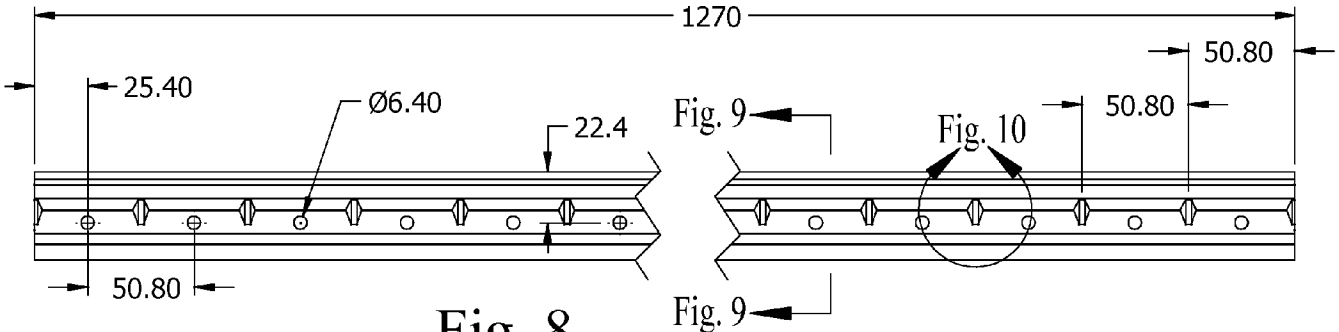
FIG. 8 is a front view of the track shown in FIG. 2 with exemplary dimensions provided in millimeters for purposes of illustration only according to exemplary embodiments.
Figure 11:
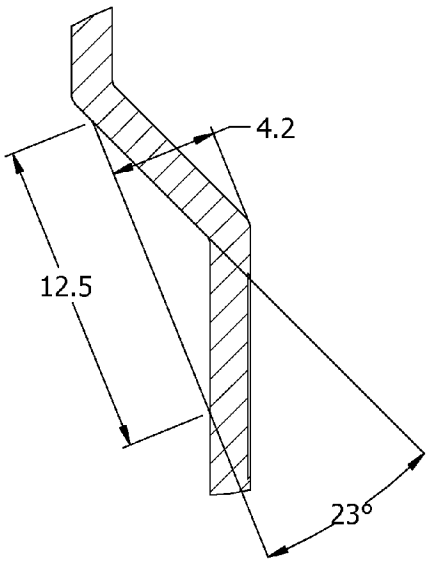
FIG. 11 is an enlarged cross-sectional view of a portion of the track shown in FIG. 8 with exemplary dimensions provided in millimeters for purposes of illustration only according to exemplary embodiments.
Figure 10:
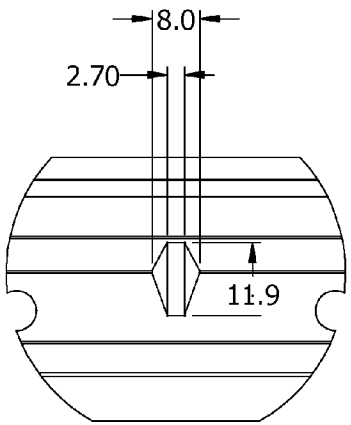
FIG. 10 is a front view of a portion of the track shown in FIG. 8 with exemplary dimensions provided in millimeters for purposes of illustration only according to exemplary embodiments.
Figure 9:
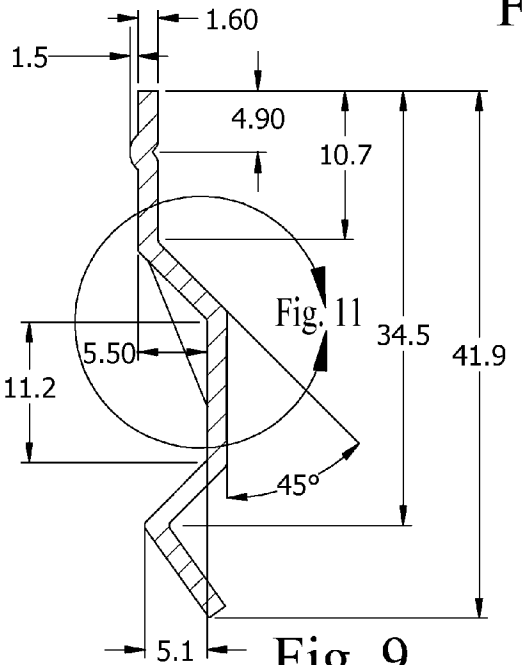
FIG. 9 is a side cross-sectional view showing the side profile of the track shown in FIG. 8 with exemplary dimensions provided in millimeters for purposes of illustration only according to exemplary embodiments.
Figure 12:
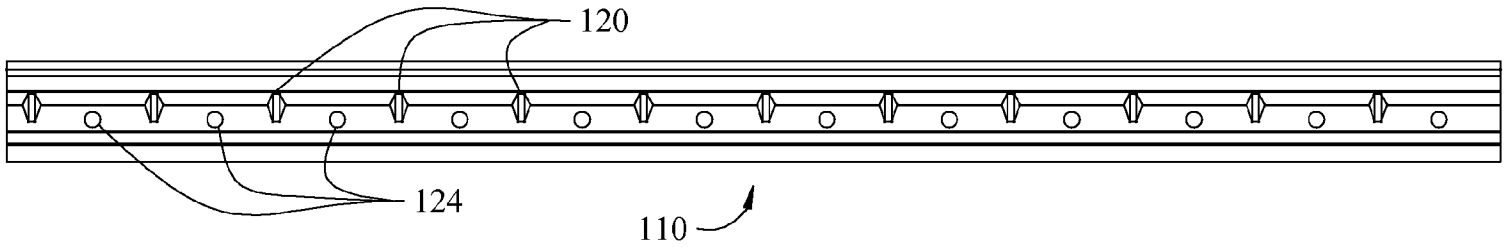
FIG. 12 is a front view of the track shown in FIG. 2.
Figure 13:
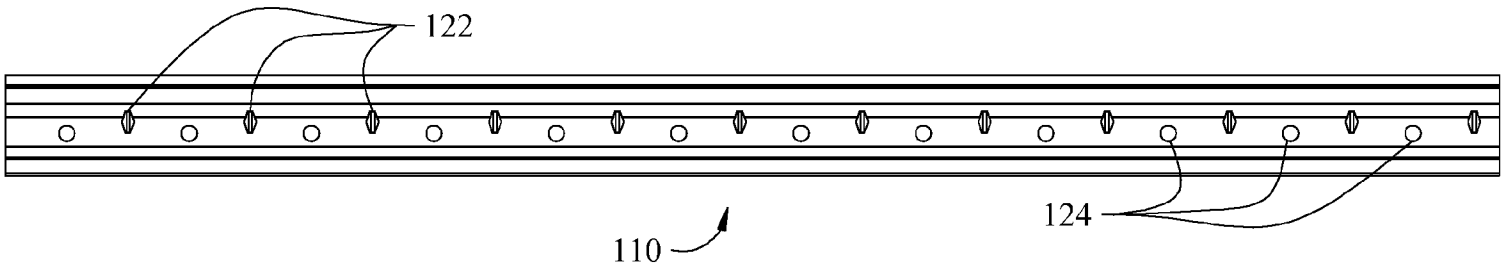
FIG. 13 is a back view of the track shown in FIG. 2.
Figure 15:
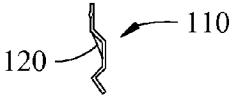
FIG. 15 is a right side end view of the track shown in FIG. 2.
Figure 14:
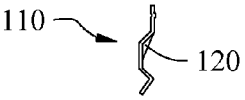
FIG. 14 is a left side end view of the track shown in FIG. 2.
Figure 16:
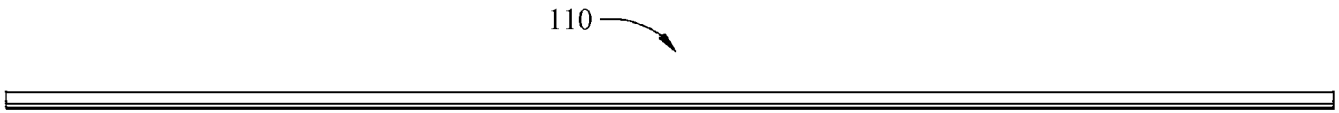
FIG. 16 is a top view of the track shown in FIG. 2.
Figure 17:
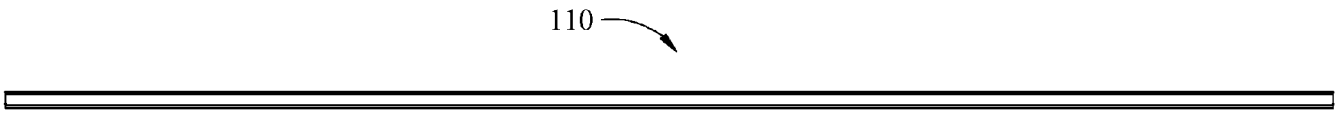
FIG. 17 is a bottom view of the track shown in FIG. 2.

The upper flange portion 112 adjoins a lower flange portion 117 so as to define an obtuse angle "A" therebetween, as shown in FIGS. 3 and 5. This obtuse angle helps enable one track 110 to suitably nest in or align with another track 110 in an overlapping manner.

Referring to FIGS. 3-7, the track 110 includes a plurality of spaced-apart, outwardly extending gussets, ribs, protruberances, protrusions or protruding portions 120 between the upper flange portion 112 and lower flange portion 117. The track 110 also includes notches, recesses, openings, or recessed portions 122 on a side opposite the ribs 120. In this particular illustrated embodiment, the notches or openings 122 are defined by or comprise the opposite or interior portion of the ribs or protruding portions 120. The spaced-apart ribs 120 are formed at the juncture 118 of the adjoining upper and lower flange portions 112, 117 in a manner such that each rib 120 defines a notch 122 on a side opposite of each rib 120.

Figure 4:
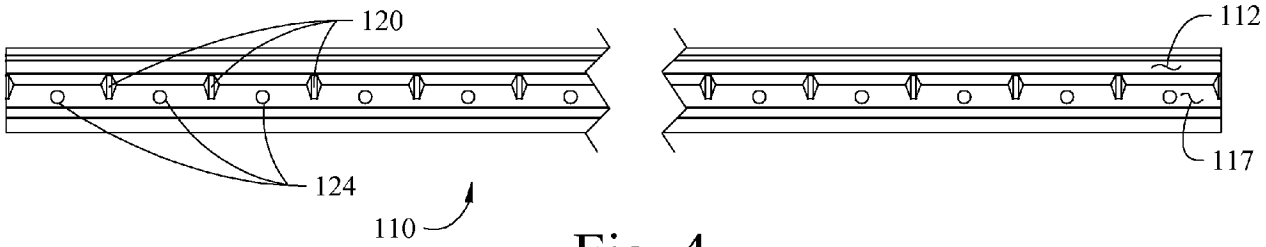
FIG. 4 is a front view of the track shown in FIG. 2.

The track 110 may further include a plurality of spaced-apart apertures or holes 124 that are disposed along the longitudinal length of the track 110. The track 110 may be provided in various lengths and is of an indeterminate length as indicated in FIG. 4 by the separation and bracket. At least one rib 120 of one track 110 is configured to slidably engage at least one notch 122 of at least one other track 110, to provide for relative positioning of one track relative to the other.

Figure 18:
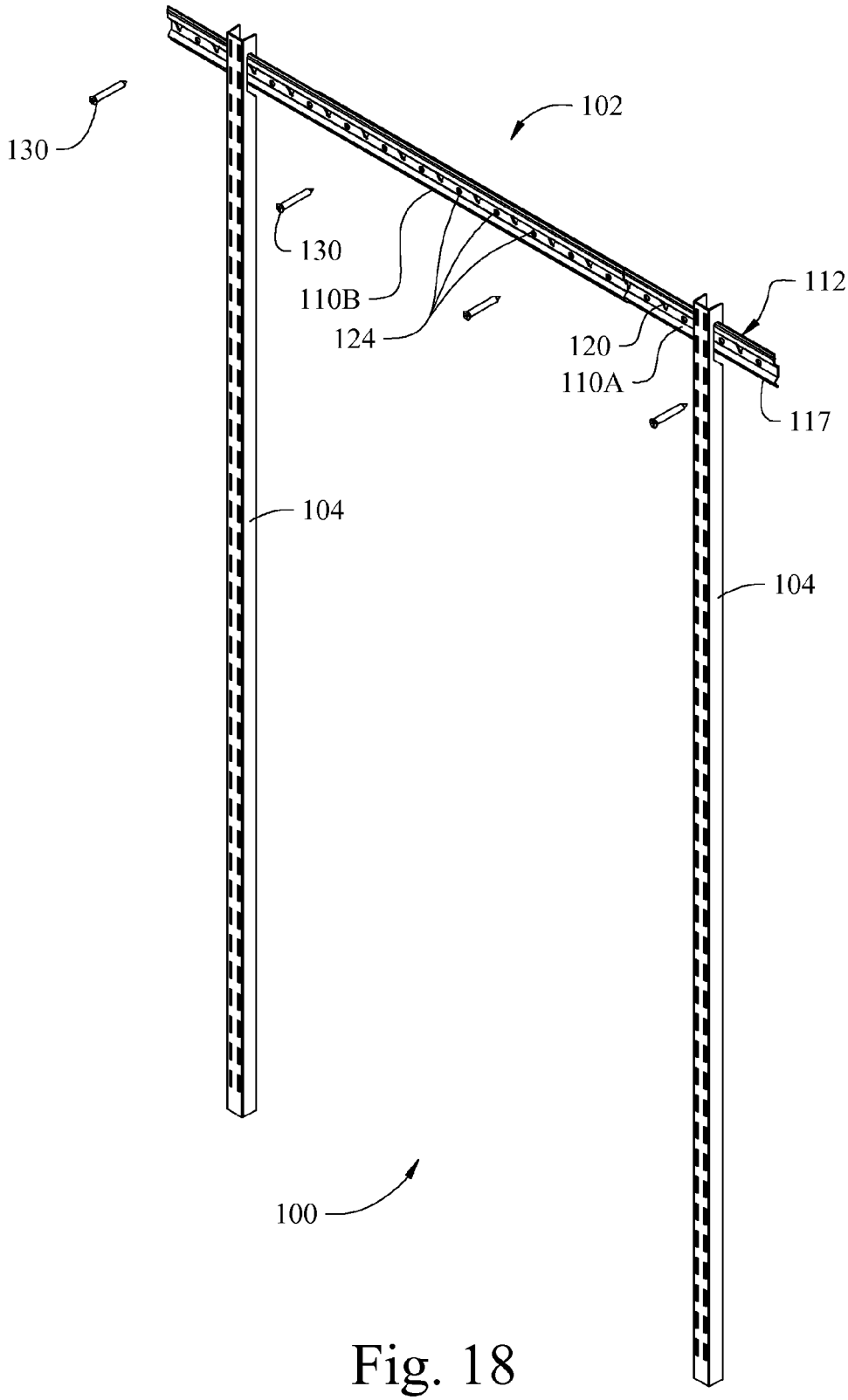
FIG. 18 is a perspective view of the adjustable shelving system shown in FIG. 1 with the tracks overlapped and standards suspended from the tracks according to an exemplary embodiment.

As shown in FIG. 18, one or more protruding portions or ribs 120 protruding outwardly relative to a front of the bottom track 110A, which is overlapped by the top track 110B. The top track 110B includes one or more notches or recessed portions 122 that extend inwardly relative to a back of the top track 110B. In this illustrated example, the slidable engagement of the bottom track's ribs 120 within the top track's notches 122 indicates that the top and bottom tracks 110 have been slidably positioned relative to each other such that their overlapping fastener holes 124 are aligned for receiving the fasteners 130.

FIGS. 8 through 11 provide exemplary dimensions in millimeters for the track 110 shown in FIG. 2 that may be used in an adjustable shelving system (e.g., 100 (FIG. 1), etc.). These dimensions provided in these figures (as are all dimensions disclosed herein) are for purposes of illustration only and not for purposes of limitation. Alternative embodiments may include one or more tracks configured differently and in different sizes.

The track 110 may be constructed of any one or more materials suitable for tracks, depending, for example, on the method used for making the track 110. By way of example, the track 110 may be formed from sheet metal, aluminum, steel (e.g., roll-formed steel, etc.), plastic, extrudable materials, metal alloys, etc. In the illustrated embodiment of FIGS. 8 through 17, the track 110 has a profile suitable for an extrusion process such that the track 110 may be formed by extruding aluminum. Alternative embodiments may include a track formed by other processes besides extrusion and from other materials besides aluminum.

Figure 33:
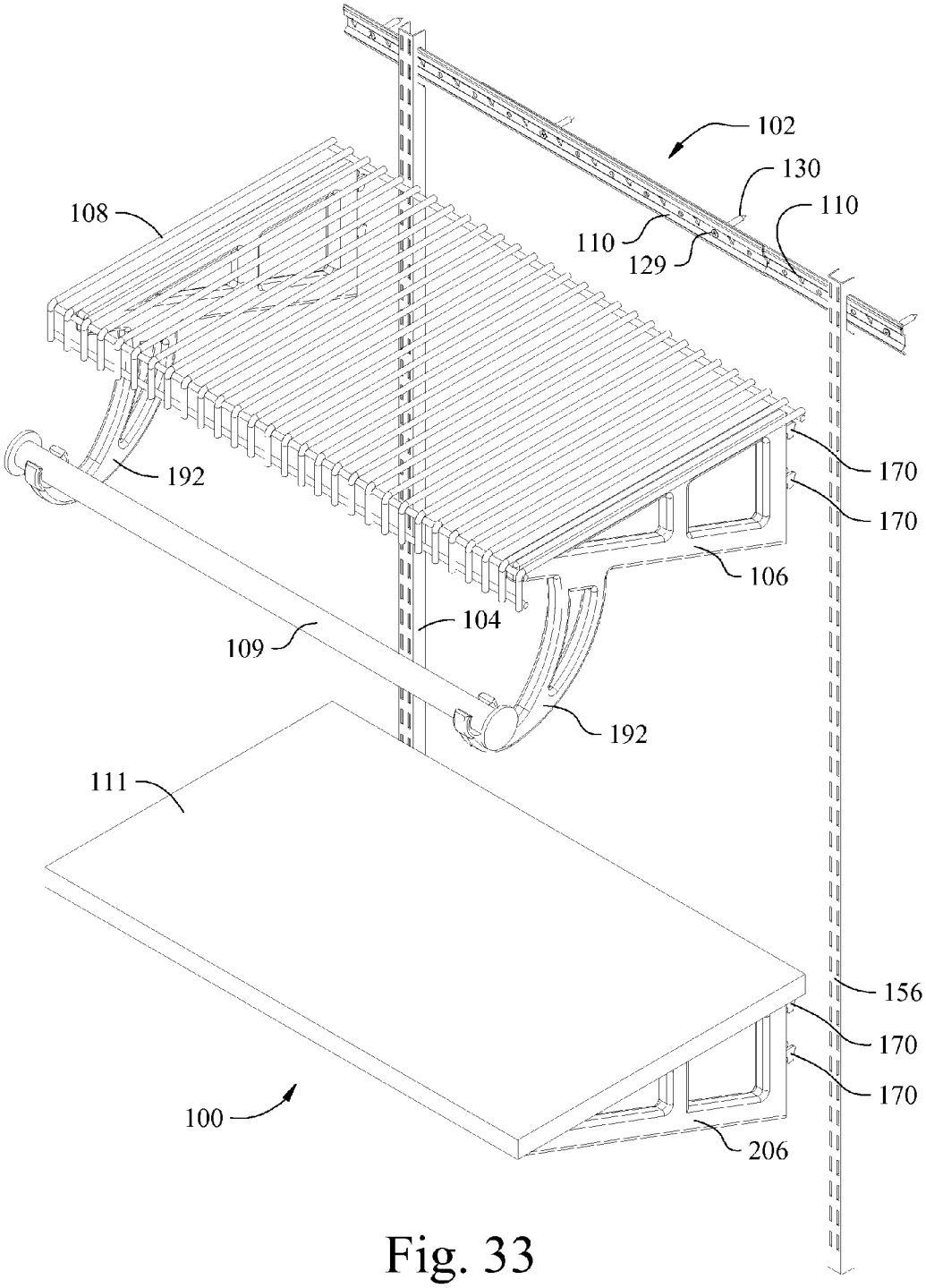
FIG. 33 is perspective view of an exemplary adjustable shelving system and illustrating the exemplary manner by which shelves may be mounted to the standards according to exemplary embodiments.
Figure 34:
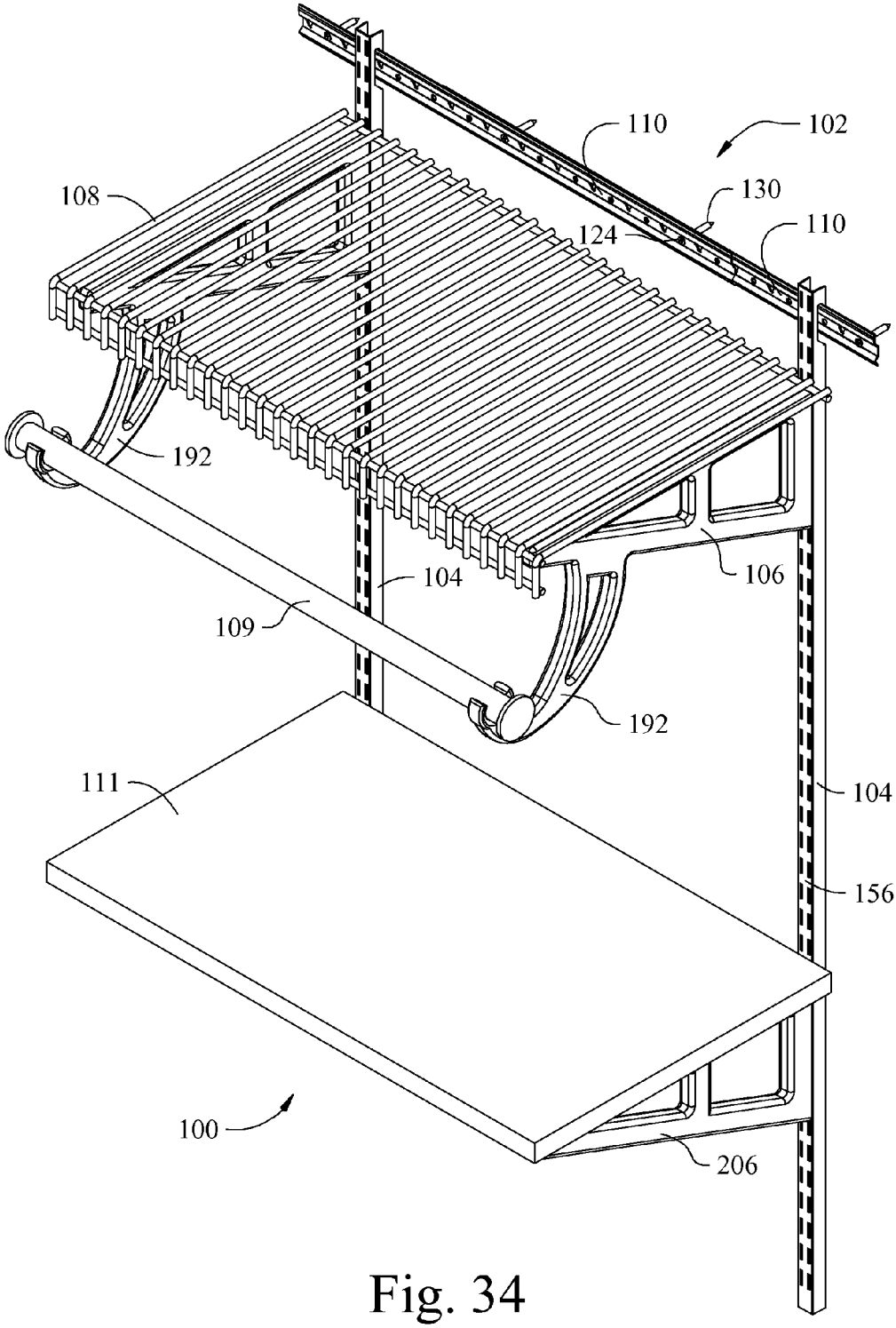
FIG. 34 is a perspective view of the exemplary adjustable shelving system shown in FIG. 33 with the shelves mounted to the standards.

Referring now to FIG. 18, a shelving system 100 is illustrated that generally includes an adjustable rail or track assembly 102 and vertical uprights or standards 104. The uprights 104 may be supported by or suspended from (e.g., positioned on and received over, etc.) by the adjustable track assembly 102. A wire shelf 108, laminate shelf 111, or other shelving may be mounted onto the vertical standards 104 as shown in FIGS. 33 and 34.

Figure 7:
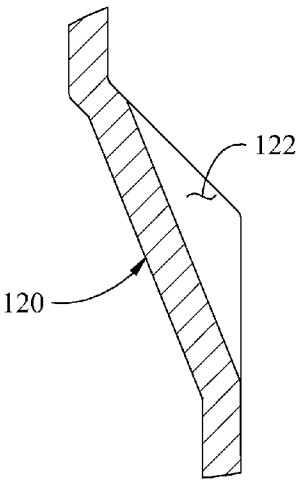
FIG. 7 is an enlarged cross-sectional view of a portion of the track shown in FIG. 2.
Figure 6:
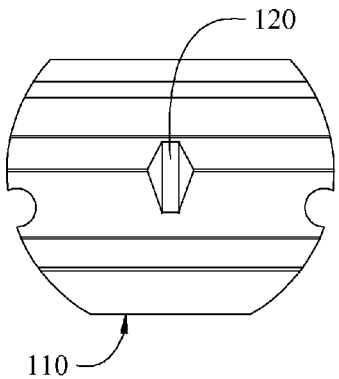
FIG. 6 is a front view of a portion of the track shown in FIG. 4.

In various embodiments, the adjustable track assembly 102 includes two tracks 110A, 110B. Alternative embodiments may include more than two tracks. As shown in FIG. 18, the two tracks 110A, 110B are arranged or configured so as to be slid relative to each other in an overlapping manner. The tracks 110A, 110B include spaced-apart ribs 120, which may be formed in a manner such that each rib 120 defines a notch 122 (as shown in FIG. 7) on a side opposite of each rib 120. At least one rib of one track 110A is configured to be slidably engaged within at least one notch 122 of the other track 110B. One track 110 may be slidably positioned relative to the other track 110B, to thereby slidably adjust the length of the overlapping tracks 110A, 110B. This enables adjusting the overall length of the track assembly 102 without requiring any cutting of either or both tracks 110A, 110B.

Figure 19:
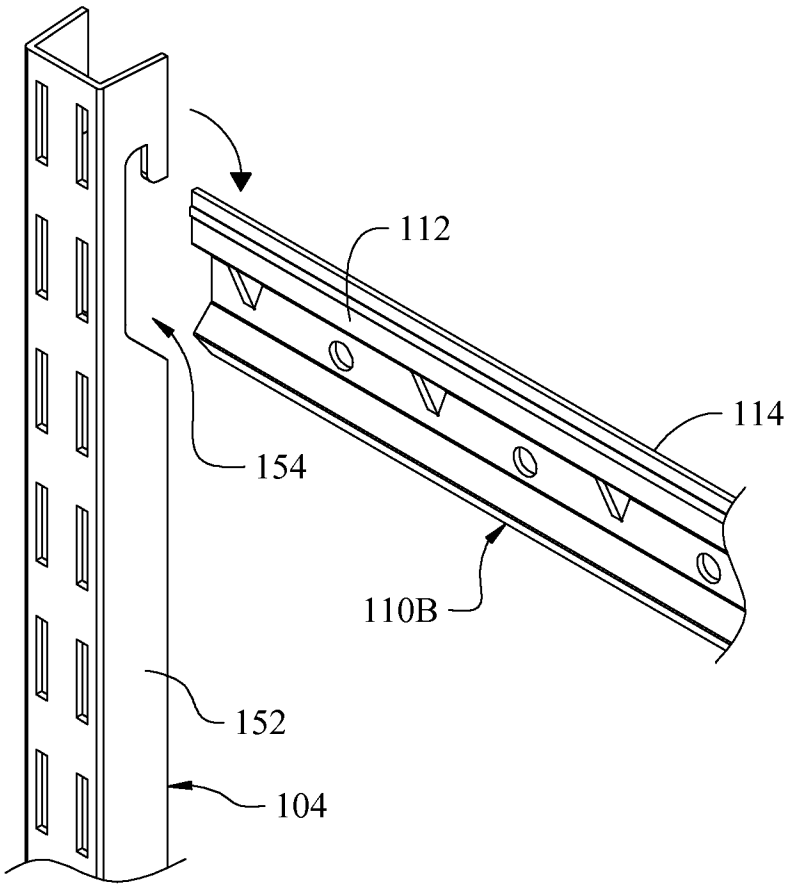
FIG. 19 is a perspective view illustrating an end portion of the standard aligned for slidable engagement with the track (as represented by an arrow) whereby the recessed portion of the standard may receive therein and be suspended from the upper flange portion of the track according to an exemplary embodiment.
Figure 20:
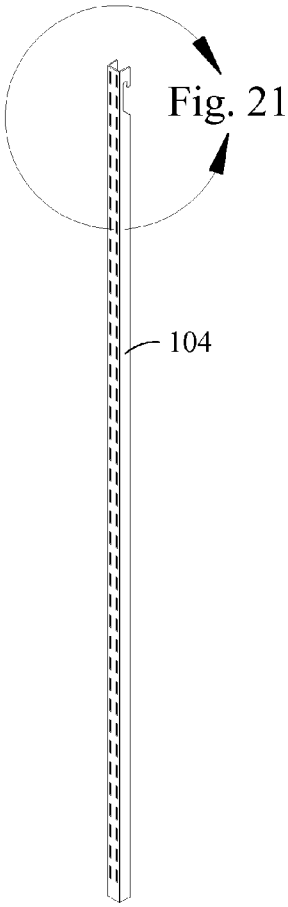
FIG. 20 is an upper perspective view of one of the two standards of the adjustable shelving system shown in FIG. 18.
Figure 22:
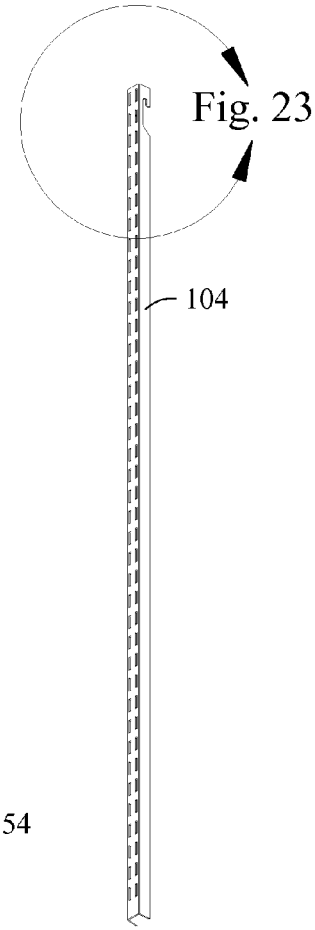
FIG. 22 is a lower perspective view of the standard shown in FIG. 20.

The shelving system 100 may further include one or more standards 104. As shown in FIG. 19, each standard 104 has opposing sidewalls 152 that include a recessed portion 154 configured to be positioned over the upper flange portion 112 of either or both tracks 110A, 110B. In this exemplary manner, the standard 104 may be supported by or suspended from the upper flange portion. With reference to FIG. 18, the position of each standard 104 relative to the other standard 104 and relative to the tracks 110A, 110B is slidably adjustable along the upper flange portion 112 of either or both tracks 110A, 110B. For example, either or both standards 104 may be slidably moved along the tracks 110A, 110B in order to position the standards 104 closer or farther away from each other.

Upon the slidable engagement of ribs 120 of one track 110A within the notches 122 of the other track 110B, one or more apertures or fastener holes 124 in the one track 110A will be aligned with one or more apertures or fastener holes 124 in the other track 110B as shown in FIG. 18. Accordingly, the slidable engagement of the ribs 120 within the notches 122 provides indexed adjustment of the relative positioning of the two tracks 110A, 110B to each other. This slidable overlapping of the tracks 110A, 110B also allows adjustment of the overall or combined length of the tracks 110A, 110B without requiring cutting or trimming of the tracks.

Fasteners 130 (FIG. 18) may be inserted through the aligned holes 124 for mounting or fastening the tracks 110A, 110B to a wall or wall stud. It should be noted that the fastener 130 may be a mounting screw with a self-drilling feature, or any other suitable screw or fastening means for securing the track 110A, 110B to a wall.

The tracks 110A, 110B may also be provided in various lengths. In some embodiments, the tracks 110A, 110B have a length that allows the standard 104 to slide horizontally along the length of the tracks 110A, 110B, thereby allowing for selective slidable adjustment of the standard's positioning relative to or along the tracks 110A, 110B.

Figure 21:
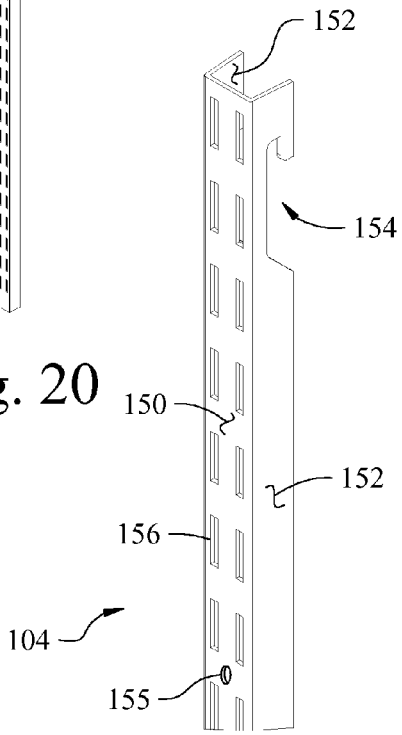
FIG. 21 is a perspective view of the portion of the standard designated as FIG. 21 in FIG. 20, and illustrating an exemplary fastener hole in the standard.
Figure 23:
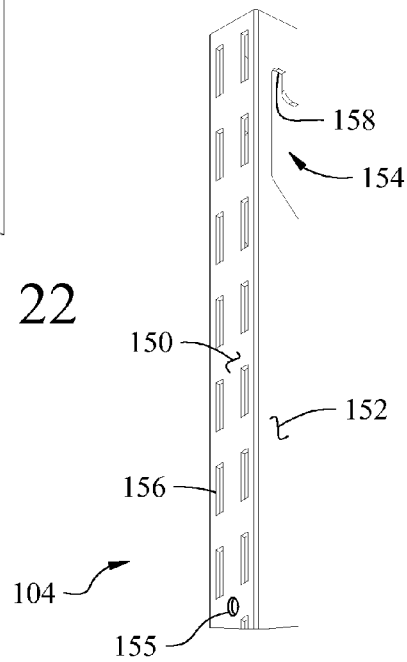
FIG. 23 is a perspective view of the portion of the standard designed FIG. 23 in FIG. 22, and also illustrating an exemplary fastener hole in the standard.
Figure 24:
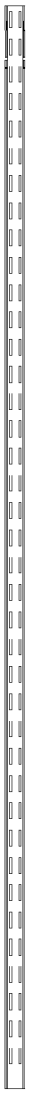
FIG. 24 is a back view of the standard shown in FIG. 20.
Figure 25:
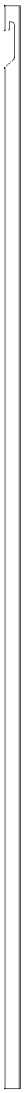
FIG. 25 is a left side view of the standard shown in FIG. 20.
Figure 26:
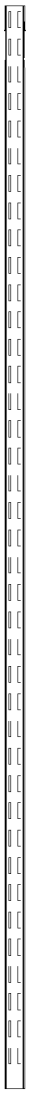
FIG. 26 is a front view of the standard shown in FIG. 20.
Figure 27:
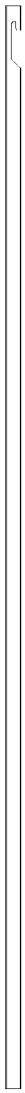
FIG. 27 is a right side view of the standard shown in FIG. 20.
Figure 28:
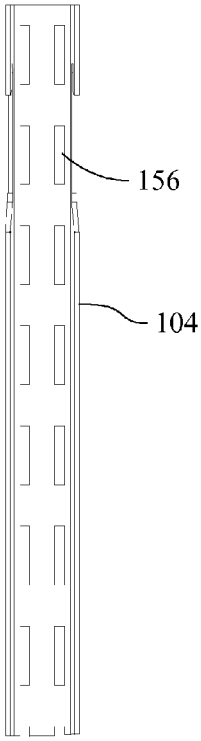
FIG. 28 is a back view of a portion of the standard shown in FIG. 24.

FIGS. 20 through 32 illustrate exemplary standards 104 that may be supported by or suspended from the tracks 110A, 110B in the adjustable shelving system 100 (FIG. 18). As shown in FIGS. 21 and 23, the standard 104 includes a forward surface 150, opposing sidewalls 152, and a rearward portion 154. In this illustrated embodiment, the rearward portion 154 comprises a contoured recessed portion having a shape complementary to a shape of the upper flange portion 112 of the tracks 110. The configuration of the recessed rearward portion 154 allows the rearward portion 154 to be slidably received over the upper flange portion 112 of the track 110.

With further reference to FIG. 21, the front surface 150 may optionally include one or more fastener holes 155 (as shown in FIG. 21). By way of example, a screw may be used for helping mount and/or stabilize the standard 104 relative to a wall or other surface, such as after the standard 104 is being supported by or suspended by the track 110. Other embodiments may include differently configured fastener holes (e.g., shapes, sizes, locations, etc.). Still other embodiments may rely on different means for holding a standard to a wall (e.g., weighting of shelving, etc.), and may not include any fastener holes 155, see, e.g., FIGS. 28-31.

The front surface 150 of the standard 104 also includes apertures or slots 156. Alternative embodiments may include differently configured slots 156 (e.g., size, shape, location, number, single column of slots, etc.) than what is shown in the figures. Instead of slots, further embodiments may include other means of mounting a bracket (e.g., protrusions, etc.) may be used on front surface 150. In other embodiments, the standard 104 may be shaped and/or dimensionally sized (e.g., shorter, longer, wider, etc.) relative to the slots 156 and/or other components of the adjustable shelving system 100.

The standard 104 includes means for retaining the standard 104 on or to the track 110. As shown in FIG. 233, the illustrated standard 104 includes a generally downwardly-facing horizontal support surface 158 for helping support the standard 104 on the upper flange portion 112 (and support surface 114) of the track 110. When the recessed portion 154 of the standard 104 is slidably received over the upper flange portion 112 of the track 110, the standard's generally downwardly-facing horizontal support surface 158 may thus contact the track's upper support surface 114, and the lower flange portion 117 of the track 110 may be at least partially received within the recessed portion 154.

In this illustrated embodiment, the sidewalls 152 of the standard 104 may be relieved or cut away to provide a retaining tab below the support surface 158. But the sidewalls 152 may be alternatively shaped and configured to permit the standard 104 to fit over the track 110. When the recessed portion 154 of the standard 104 is slidably positioned over the upper flange portion 112 (as represented by the arrow shown in FIG. 19), the standard's support surface 158 (FIG. 23) is generally horizontal in orientation. With the standard 104 supported by or suspended from the track 110, the standard's generally downwardly-facing horizontal support surface 158 rests on and is supported by the track 110. The standard's support surface 158 may be slidably moved along the track's upper flange portion 112 to thereby adjustably position the location of the standard 104 relative to the track 110.

Figure 29:
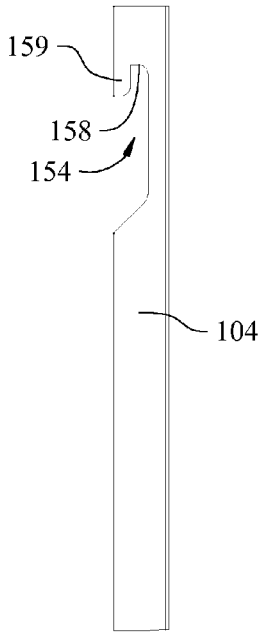
FIG. 29 is a left side view of a portion of the standard shown in FIG. 25.
Figure 30:
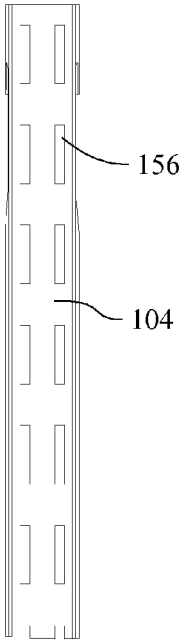
FIG. 30 is a front view of a portion of the standard shown in FIG. 26.
Figure 31:
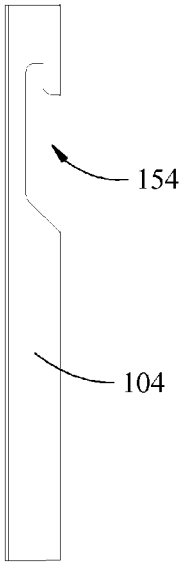
FIG. 31 is a right side view of a portion of the standard shown in FIG. 27.
Figure 32:
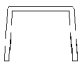
FIG. 32 is an end view of the standard shown in FIG. 30.

FIG. 29 illustrates a retaining tab 159 extending below the support surface 158 of the standard 104. The retaining tab 159 may be configured to abut the upper flange portion 112 of the track 110, to thereby help retain or hold the standard 104 onto the track 110 in some embodiments. This, in turn, may help provide relatively secure, positive locking of the standard 104 to the track 110 and/or help retain the standard 104 so that the standard 104 is not inadvertently released from the track 110, for example, when the standard 104 is jarred or bumped into by a person walking by, etc. In alternative embodiments, other means (e.g., latch or other mechanism, etc.) may be used instead of the retaining tab for helping the standard 104 remain supported by the track 110. With the standard 104 in a desired position along the track 110, the hanging or lower portion of the standard 104 not engaged with the track 110 may optionally be secured to a wall (via a screw, for example) to prevent or inhibit any further movement of the standard 104 from its desired position. The standard 104 may be constructed of any suitable material, such as plastic, metal, metal alloys, etc. In one exemplary embodiment, the standard 104 is formed from sheet metal. Accordingly, various embodiments disclosed herein include standards and tracks that are configured with integrated locking features or means for locking that allow an installer to adjustably position (e.g., slide, etc.) a standard relative to the track before the standard is secured against a wall or other surface (e.g., with screws, etc.).

Referring to FIGS. 33 and 34, a shelving system 100 is shown that includes two tracks 110 configured to slide relative to each other in an overlapping manner to provide an adjustable rail or track assembly 102. As explained above, the tracks 110 include an upper flange portion 112 that adjoins a lower flange portion 117. The tracks 110 also include spaced-apart ribs or gussets 120 formed at the juncture 118 of the adjoining upper and lower flange portions 112, 117 such that each rib 120 defines a notch 122 on the reverse side of the track 110. The ribs 120 form protuberances that engage the notches 122 to position one track relative to the other track such that pairs of apertures or openings 124 of the tracks 110 are aligned with each other. At least one rib 120 of one track 110 is configured to slidably engage at least one notch 122 of at least one other track 110, to provide for relative positioning of one track relative to the other. The slidably adjustable tracks 110 thus enable the tracks 110 to be movable to an appropriate length as desired for accommodating a particular shelf, while maintaining alignment of two or more apertures 124 in the tracks 110 for insertion of fasteners to secure or fasten the tracks 110 to a wall or wall stud.

With the tracks 110 being easily mounted and adjustable to an appropriate position, the standards 104 may then be engaged with the tracks 110 and slid to the appropriate spacing to accommodate a wire shelf, laminate shelf, etc. As shown in FIG. 19, the contoured recessed portion 154 of the standard 104 engages the upper flange portion 112 (and support surface 114) of the track 110. The standard 104 is configured to slide along the track 110 such that each standard may be adjustably positioned along the length of each track 110. The standard 104 includes slots 156 that are configured to receive the tabs of a bracket (e.g., tabs 170 of bracket 106 or tabs of bracket 206 shown in FIG. 33).

In this exemplary embodiment illustrated in FIGS. 33 and 34, both of the two illustrated standards 104 may be identical to each other and include similar features as the standard 104 shown in FIGS. 20 through 27. Alternative embodiments may include standards that are not identical to each other (e.g., have different lengths, different slot configurations, etc.) and/or that are dissimilar to the standard 104 shown in FIGS. 20 through 32. In the embodiments shown in FIGS. 33 and 34, the standards 104 are configured to be attached to the tracks 110 without mechanical fasteners, clips, etc., for securing the standards 104 to a wall.

With the standards 104 installed and positioned accordingly, brackets 106, 206 may relatively easily be engaged to the standards 104. FIGS. 33 and 34 illustrate an exemplary shelf/shelving bracket 106 that may be used with the adjustable shelving system 100 shown in FIG. 1. The bracket 106 may be supported by a standard 104 mounted against a wall such that a shelf (e.g., wire shelf 108 or laminate shelf 111 shown in FIG. 33) may then be supported atop the bracket 106, 206. The brackets 106, 206 may be constructed of any suitable material. By way of example only, the brackets 106, 206 may be formed from sheet metal. In addition, the brackets 106, 206 may also be provided in various lengths depending, for example, on the width of the particular shelf to be supported by the brackets. For example, the bracket 106 may have an overall length of about sixteen inches in some embodiments. Also by way of example, the bracket 206 may have an overall length of about twelve inches in some embodiments.

As shown in FIG. 33, each shelf/shelving bracket has a main body portion and tabs 170. The tabs 170 are configured to be inserted and received in the slots 156 in the standard 104 in a manner such that the bracket 106 is inhibited from dislodging from the standard 104. Accordingly, the brackets may be installed by inserting the bracket tabs 170 into slots 156 of the standard 104.

The adjustable shelving system 100 may also include a wire shelf 108 having longitudinal rods that are configured to be positioned on the top of the support bracket. FIG. 33 illustrates an exemplary wire shelf 108 that may be used with the adjustable shelving system 100 shown in FIG. 33. As shown in FIG. 33, the wire shelf 108 may be supported atop the shelf/shelving brackets 106, which, in turn, are supported by standards 104 supported from tracks 110 mounted to a wall. Also shown in FIG. 33, the wire shelf 108 includes transversely extending wire members (e.g., wire stringers, etc.) supported by longitudinally extending support members to form a shelf deck. The transversely extending wire members are typically spaced to provide a ventilated shelf deck construction, while preventing or inhibiting items from falling through the spaces between the transversely extending wire members.

The wire shelf 108 may be constructed of any suitable material, such as metals, metal alloys, plastic, etc. In one exemplary embodiment, the wire shelf 108 is formed from steel wires. In addition, the wire shelf 108 is but one example of a shelf that may be supported atop brackets of the adjustable shelving system 100. The particular wire shelf 108 shown in FIG. 33 is for purposes of illustration only as various aspects of the invention can be used with a wide range of other shelves and storage products, including wire ventilated shelves having different configurations than what is shown in FIG. 33, trays, laminate shelves (e.g., laminate shelf 111), etc. Accordingly, the specific references to wire shelf herein should not be construed as limiting the scope of the invention to only one specific form/type of wire shelf.

A ventilated or wire shelf 108 may be supported atop or by brackets 106, or alternatively a laminate shelf 111 (e.g., laminate shelf, wooden shelf, etc.) may also be supported by brackets 206. In this embodiment of an adjustable shelving system, there may also be provided a hang rod assembly, as described below.

FIG. 34 illustrates an exemplary hang/hanger rod assembly 109 of the adjustable shelving system 100 in FIG. 1 according to exemplary embodiments. As shown in FIGS. 33 and 34, the hang rod assembly 109 generally includes hang rod mounting brackets 192 (which may be supported by, suspended from, or be integral to the brackets 106, 206) and a hang/hanger rod. In other embodiments, however, an adjustable shelving system may not include any such hang rod assembly. The hang rod mounting bracket 192 may include a main bracket portion and tabs, where the tabs are configured to be inserted into openings of the shelf/shelving bracket 106.

By way of example, an installer may customize a modular shelving system for a particular installation (e.g., reach-in closet or walk-in closet, etc.) by selecting from amongst various components and accessories contained in a kit, which includes the adjustable rail or track assembly 102, standards 104, etc. In addition, aspects of the present disclosure include the individual components themselves of the adjustable shelving systems and assemblies disclosed herein. In addition, exemplary embodiments disclosed herein include systems and components thereof that may provide greater support, customization, modularity, adjustability, and consumer flexibility to closet shelving arrangements.

Numerical dimensions and values are provided herein for illustrative purposes only. The particular dimensions and values provided are not intended to limit the scope of the present disclosure.

Spatially relative terms, such as "inner," "outer," "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The disclosure herein of particular values and particular ranges of values for given parameters are not exclusive of other values and ranges of values that may be useful in one or more of the examples disclosed herein. Moreover, it is envisioned that any two particular values for a specific parameter stated herein may define the endpoints of a range of values that may be suitable for the given parameter. The disclosure of a first value and a second value for a given parameter can be interpreted as disclosing that any value between the first and second values could also be employed for the given parameter. Similarly, it is envisioned that disclosure of two or more ranges of values for a parameter (whether such ranges are nested, overlapping or distinct) subsume all possible combination of ranges for the value that might be claimed using endpoints of the disclosed ranges.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. A shelving system comprising:

a first track member defining a first length, the first track member including multiple ribs distributed over at least a majority of the first length and multiple notches defined in a side of the first track member opposite the multiple ribs; and a second track member defining a second length, the second track member including multiple ribs disposed along at least a majority of the second length and multiple notches defined in a side of the second track member opposite the multiple ribs, wherein at least one of the multiple ribs of the first track member is configured to engage with one of the multiple notches of the second track member to inhibit relative sliding movement between the first and second track members;

wherein:

the first track member includes an upper flange portion and a lower flange portion;

at least a portion of each of the upper and lower flange portions define an obtuse angle;

the multiple ribs of the first track member are disposed within said obtuse angle;

the upper flange of the first track member includes a lip portion; and the shelving system further comprises at least one standard having a recessed portion configured to engage the lip portion of the first track member and slide relative thereto.

2. The shelving system of claim 1, wherein the first and second track members are structured to permit the at least one rib of the first track member to engage different ones of the notches of the second track member for indexing adjustment of an overall length of the first and second track members.

3. The shelving system of claim 1, wherein the first and second track members each define a profile structured such that a portion of the first track member nests within a portion of the second track member.

4. The shelving system of claim 3, wherein the profile of the first track member is substantially the same as the profile of the second track member.

5. The shelving system of claim 1, wherein each of the multiple notches of the first track member is integrally formed with one of the multiple ribs of the first track member.

6. The shelving system of claim 1, wherein each of the multiple ribs of the first track member is spaced apart from adjacent ribs of the first track member by a substantially uniform distance.

7. The shelving system of claim 1, wherein the first track member and the second track member each defines multiple mounting apertures such that at least one of the multiple mounting apertures of the first track member aligns with at least one of the multiple mounting apertures of the second track member when the at least one of the multiple ribs of the first track member is engaged with the one of the multiple notches of the second track member.

8. The shelving system of claim 1, wherein at least one of the first and second track members comprises;

an elongate member defining a profile structured to at least partially nest within another another elongate member having a substantially identical profile, the elongate member defining a length and multiple mounting apertures for fastening the track to a structure; and multiple engagement features disposed along at least a majority of the length of the elongate member, each said engagement feature including a projection on a first side of the elongate member and a receptacle on an opposite side of the elongate member.

9. A shelving system comprising:

a first track member defining a first length, the first track member including multiple ribs distributed over at least a majority of the first length and multiple notches defined in a side of the first track member opposite the multiple ribs; and a second track member defining a second length, the second track member including multiple ribs disposed along at least a majority of the second length and multiple notches defined in a side of the second track member opposite the multiple ribs, wherein at least one of the multiple ribs of the first track member is configured to engage with one of the multiple notches of the second track member to inhibit relative sliding movement between the first and second track members;

wherein the first and second track members respectively comprise first and second elongate members, each elongate member comprising:

a first flange portion; and a second flange portion that adjoins the first flange portion such that the first flange portion and second flange portion define an angle therebetween, the angle being less than 180 degrees;

wherein the multiple ribs comprise multiple projections coupled to at least one of the first and second flange portions and disposed within said angle; and wherein the multiple notches comprise multiple receptacles defined in at least one of the first and second flange portions on a side of said elongate member opposite the multiple projections;

wherein one or more of the multiple receptacles of the first elongate member are configured to communicate with one or more of the multiple projections of the second elongate member to inhibit relative sliding movement of the first and second elongate members.

10. The shelving system of claim 9, wherein:

each said first and second elongate member includes a lip portion adjoining the first flange portion; and the shelving system further comprises at least one standard configured to communicate with at least the lip portion of the first elongate member, such that the at least one standard is slidable along and supportable by the first elongate member, thereby allowing the position of the at least one standard to be slidably adjusted.

11. The shelving system of claim 9, wherein the first and second elongate members each defines substantially the same profile, such that the first and second elongate members slide relative to one another to facilitate communication between the one or more of the multiple receptacles of the first elongate member with the one or more of the multiple projections of the second elongate member.

12. The shelving system of claim 11, wherein the first and second elongate members are configured such that the communication of the one or more of the multiple projections with the one or more of the multiple receptacles provides at least one of a tactile indication and an audible indication that the first and second elongate members are slidably aligned with the one or more of the multiple receptacles of the first elongate member in communication with the one or more of the multiple projections of the second elongate member.

13. The shelving system of claim 11, wherein each second flange portion defines multiple mounting apertures such that at least one of the multiple mounting apertures of the first elongate member aligns with one of the multiple mounting members of the second elongate member, when the one or more of the multiple receptacles of the first elongate member communicate with the one or more of the multiple projections of the second elongate member.

14. The shelving system of claim 9, wherein:

the multiple projections of the first elongate member are spaced apart from one another such that the space between adjacent projections is substantially uniform; and the multiple projections of the second elongate member are spaced apart from one another such that the space between adjacent projections is substantially uniform.

15. The shelving system of claim 9, wherein said angle is an obtuse angle.

16. The shelving system of claim 9, wherein the multiple projections of the first elongate member are integrally formed with the multiple receptacles of the first elongate member.

17. A shelving system comprising:

a first track member defining a first length, the first track member including multiple ribs distributed over at least a majority of the first length and multiple notches defined in a side of the first track member opposite the multiple ribs; and a second track member defining a second length, the second track member including multiple ribs disposed along at least a majority of the second length and multiple notches defined in a side of the second track member opposite the multiple ribs, wherein at least one of the multiple ribs of the first track member is configured to engage with one of the multiple notches of the second track member to inhibit relative sliding movement between the first and second track members;

wherein at least one of the first and second track members comprises:

an elongate member defining a profile structured to at least partially nest within another elongate member having a substantially identical profile, the elongate member defining a length and multiple mounting apertures for fastening the track to a structure;

multiple engagement features disposed along at least a majority of the length of the elongate member, each said engagement feature including a projection on a first side of the elongate member and a receptacle on an opposite side of the elongate member;

the elongate member includes an upper flange portion and a lower flange portion;

the upper and lower flange portions define an obtuse angle; and each said projection is disposed within the obtuse angle.

18. The shelving system of claim 17 wherein:

the first track member comprises the elongate member that includes the upper flange portion and the lower flange portion;

and the multiple ribs of the first track member are disposed within said obtuse angle.

19. The shelving system of claim 18, wherein:

the upper flange of the first track member includes a lip portion; and the shelving system further comprises at least one standard having a recessed portion configured to engage the lip portion of the first track member and slide relative thereto.

20. The shelving system of claim 17, wherein:

the multiple engagement features are substantially evenly distributed along at least a majority portion of the length of the elongate member; and each said receptacle includes a notch.

* * * * *